US009565877B2

(12) United States Patent
Martinet et al.

(10) Patent No.: US 9,565,877 B2
(45) Date of Patent: Feb. 14, 2017

(54) GARMENT THAT CLINGS TO A WEARER'S SKIN AND METHOD OF MANUFACTURE THEREOF

(71) Applicant: Mast Industries (Far East) Limited, Kowloon (HK)

(72) Inventors: Nathalie Martinet, Saikung (HK); Mayur Vansia, Wayne, NJ (US); Suet Hing Yip, Tai Wai (HK)

(73) Assignee: Mast Industries (Far East) Limited, Kowloon (GB)

( * ) Notice: Subject to any disclaimer, the term of this patent is extended or adjusted under 35 U.S.C. 154(b) by 195 days.

(21) Appl. No.: 14/505,895

(22) Filed: Oct. 3, 2014

(65) Prior Publication Data

US 2015/0111466 A1 Apr. 23, 2015

Related U.S. Application Data

(60) Provisional application No. 61/892,678, filed on Oct. 18, 2013.

(51) Int. Cl.
*A41C 3/06* (2006.01)

(52) U.S. Cl.
CPC ..... *A41C 3/065* (2013.01); *A41B 2400/82* (2013.01); *A41B 2500/10* (2013.01)

(58) Field of Classification Search
CPC ..... A41C 5/00; A41C 3/00; A41C 3/12; A41C 3/0057; A41C 3/0007; A41C 3/0014
USPC ..... 450/39, 81, 88, 54–57, 58
See application file for complete search history.

(56) References Cited

U.S. PATENT DOCUMENTS

| | | | | |
|---|---|---|---|---|
| 222,752 | A | 12/1879 | Townsend | |
| 1,164,642 | A | 12/1915 | Guinzburg | |
| 1,254,043 | A | 1/1918 | James | |
| 1,811,843 | A * | 6/1931 | Chisholm | D03D 15/10 139/421 |

(Continued)

FOREIGN PATENT DOCUMENTS

| | | | |
|---|---|---|---|
| EP | 0592668 | A1 | 4/1994 |
| EP | 1591574 | A1 | 11/2005 |

(Continued)

OTHER PUBLICATIONS

Bruer et al.,Three-Dimensionally Knit Spacer Fabrics: A Review of Production Techniques and Application, Journal of Textile and Apparel and Management, vol. 4, Issue 4, Summer 2005.

(Continued)

*Primary Examiner* — Gloria Hale
(74) *Attorney, Agent, or Firm* — Andrus Intellectual Property Law, LLP

(57) ABSTRACT

A bra includes a pair of bra cups, each bra cup in the pair having an inner edge and an outer edge, the inner edges configured to be coupled to one another. The bra includes a pair of bra wings, each bra wing in the pair having a first end and a second end, each first end being coupled to an outer edge of each bra cup, respectively, and the second ends configured to be coupled to one another. At least one of the pair of bra cups and the pair of bra wings comprises a layer of fabric having intrinsically sticky fibers. The layer of fabric having intrinsically sticky fibers comprises an inner layer of the pair of bra cups and/or the pair of bra wings and contacts a wearer's skin while the bra is being worn, causing the bra to cling to the wearer's skin.

20 Claims, 8 Drawing Sheets

(56) References Cited

U.S. PATENT DOCUMENTS

| | | | | |
|---|---|---|---|---|
| 3,254,653 | A * | 6/1966 | Krieger | A41C 3/00 450/39 |
| 3,590,823 | A * | 7/1971 | Pope, Jr. | A41F 11/18 2/239 |
| 3,595,243 | A | 7/1971 | Mount | |
| 3,930,090 | A * | 12/1975 | Campbell, Sr. | A41F 9/00 2/221 |
| 4,131,731 | A | 12/1978 | Lai et al. | |
| 4,325,378 | A | 4/1982 | Wilkinson | |
| 4,557,267 | A * | 12/1985 | Cole | A41C 3/00 450/40 |
| 4,601,940 | A | 7/1986 | Fischer | |
| 4,797,954 | A | 1/1989 | Williams | |
| 4,877,856 | A | 10/1989 | Hall et al. | |
| 5,385,036 | A | 1/1995 | Spillane et al. | |
| 5,604,561 | A * | 2/1997 | Ozawa | G02B 7/34 396/125 |
| 5,885,910 | A * | 3/1999 | Graichen | D04B 1/10 427/372.2 |
| 5,946,726 | A | 9/1999 | Green | |
| 5,968,003 | A | 10/1999 | Sisson | |
| 6,059,633 | A | 5/2000 | Currier | |
| 6,186,862 | B1 | 2/2001 | Fildan | |
| 6,332,825 | B1 * | 12/2001 | Henricksen | A41C 3/0057 450/1 |
| 6,446,268 | B1 * | 9/2002 | Lazarian | A41B 11/126 2/237 |
| 6,709,147 | B1 | 3/2004 | Rauwendaal | |
| 6,779,369 | B2 | 8/2004 | Shepherd | |
| 7,186,163 | B2 | 3/2007 | Carlucci | |
| 7,202,322 | B2 | 4/2007 | Vedula et al. | |
| 7,214,120 | B2 | 5/2007 | Kaye et al. | |
| 7,228,809 | B2 * | 6/2007 | Angelino | A41D 27/245 112/440 |
| 7,422,508 | B2 * | 9/2008 | Bentham | A41C 3/0014 2/243.1 |
| 7,611,999 | B2 | 11/2009 | McMurray | |
| 7,628,675 | B2 | 12/2009 | Staub | |
| 7,763,351 | B2 | 7/2010 | Vedula et al. | |
| 7,799,255 | B2 | 9/2010 | Vedula et al. | |
| 8,403,724 | B1 | 3/2013 | Chapin | |
| 8,480,452 | B2 | 7/2013 | Reinisch et al. | |
| 8,545,287 | B2 | 10/2013 | Campbell | |
| 8,758,081 | B2 | 6/2014 | Yuasa | |
| 8,858,295 | B2 | 10/2014 | Thompson | |
| 9,192,197 | B2 | 11/2015 | Reinhard | |
| 2004/0092696 | A1 | 5/2004 | Vedula et al. | |
| 2004/0168479 | A1 | 9/2004 | McMurray | |
| 2004/0266301 | A1 | 12/2004 | Vedula et al. | |
| 2005/0112996 | A1 | 5/2005 | Buehler | |
| 2005/0266770 | A1 * | 12/2005 | Henricksen | A41C 3/0007 450/1 |
| 2006/0154053 | A1 | 7/2006 | Cain et al. | |
| 2007/0004314 | A1 | 1/2007 | Carlucci | |
| 2007/0082579 | A1 | 4/2007 | Baran et al. | |
| 2007/0238392 | A1 | 10/2007 | Starbuck et al. | |
| 2008/0153388 | A1 * | 6/2008 | Liu | A41C 3/00 450/39 |
| 2008/0261490 | A1 * | 10/2008 | Scheininger | A41C 3/12 450/39 |
| 2008/0261491 | A1 * | 10/2008 | Scheininger | A41C 3/12 450/41 |
| 2009/0047481 | A1 * | 2/2009 | Welsch | A41O 5/00 428/179 |
| 2009/0053441 | A1 | 2/2009 | Cain et al. | |
| 2010/0093258 | A1 | 4/2010 | Glenn et al. | |
| 2010/0144242 | A1 * | 6/2010 | Allen | A41C 3/12 450/39 |
| 2010/0183814 | A1 * | 7/2010 | Rios | E04F 15/02161 427/387 |
| 2010/0248575 | A1 | 9/2010 | Malz | |
| 2010/0297911 | A1 * | 11/2010 | Liu | A41C 3/12 450/39 |
| 2010/0325782 | A1 | 12/2010 | Vedula et al. | |
| 2011/0312245 | A1 * | 12/2011 | Allen | A41C 3/00 450/41 |
| 2012/0021669 | A1 | 1/2012 | Johnstone | |
| 2012/0045967 | A1 | 2/2012 | Punsal | |
| 2012/0276811 | A1 | 11/2012 | Nakajima | |
| 2013/0316616 | A1 | 11/2013 | Thompson | |

FOREIGN PATENT DOCUMENTS

| | | | |
|---|---|---|---|
| GB | 2305870 | A | 4/1997 |
| GB | 2399519 | B | 9/2004 |
| WO | 0112896 | A1 | 2/2001 |
| WO | 2005005697 | A1 | 1/2005 |
| WO | 2007076380 | A2 | 7/2007 |
| WO | 2008055860 | A2 | 5/2008 |
| WO | 2009055361 | A1 | 4/2009 |
| WO | 2010151633 | A1 | 12/2010 |

OTHER PUBLICATIONS

M&S Memory Foam Multiway Bra, http://www.marksandspencer.com/memory-foam-multiway-a-dd-bra/p/p22174459#product-info, website visited on Aug. 28, 2014.

Stretchline Stay4Sure, http://www.stretchline.com/stay4sure.html, web site visited on Sep. 26, 2013.

UpBra's Miraculous Stay-Up Strapless, http://www.upbra.com/strapless.htm, web site visited on Aug. 28, 2014.

Wacoal Fibre-J Lace Bra, http://www.wacoal.com.sg/product-detail.php?prdid=76&page=2&category=1&search=38,40,42,81, web site visited on Aug. 28, 2014.

Wacoal Sensual Comfort with Fiber-J, http://www.wacoal.com.sg/news.php?n=5, published Sep. 27, 2013, web site visited on Aug. 28, 2014.

* cited by examiner

GARMENT THAT CLINGS TO A WEARER'S SKIN AND METHOD OF MANUFACTURE THEREOF

CROSS REFERENCE TO RELATED APPLICATION

This application claims priority to U.S. Provisional Application No. 61/892,678, filed Oct. 18, 2013, which is hereby incorporated by reference in its entirety.

FIELD

The present disclosure relates to the field of garments and materials that can be used to construct garments.

BACKGROUND

Intimate wear, active wear, and shape wear grip to a wearer's body at focused pressure points, such as waistbands or other apertures for a wearer's torso and/or limbs. For example, strapless garments such as bras or tube tops usually grip to a wearer's body at several pressure points: along, a bra wing in the underarm region at both the top and bottom edge of the bra wing band. These pressure points and the pressure level are the focus for maintaining the strapless garment in place on the wearer's torso.

SUMMARY

This Summary is provided to introduce a selection of concepts that are further described below in the Detailed Description. This Summary is not intended to identify key or essential features of potentially claimed subject matter, nor is it intended to be used as an aid in limiting the scope of potentially claimed subject matter.

The present disclosure relates to a garment comprising a fabric that is knit so as to purposefully cling and grip to a wearer's body. Yarns made from, for example, thermoplastic polyurethane polymers, spandex, and/or latex may be used for such purposes. The yarns are knit into fabric such that they contact a wearer's skin, thereby providing an all-over clinging/gripping effect to the garment. Other features may be incorporated into bands, straps, and/or around apertures for a wearer's limbs, such as printing with silicone to enhance a clinging/gripping, effect at these areas. Glue bonding may be used to apply elastic to these areas, or wherever elastic is desired on a garment. Overall, a garment with such features dings to a wearer's body over the entire surface of the garment that is in contact with the wearer's body, rather than at the above-mentioned (or other) pressure points. The garment therefore stays in place and provides a tight-to-skin feel, while remaining lightweight and breathable.

The present disclosure therefore applies to any garment for which this tight-to-skin feel is desired, and is not limited to the exemplary strapless bra disclosed herein.

In one example of the present disclosure, a bra comprises a pair of bra cups, each bra cup in the pair having an inner edge and an outer edge, the inner edges configured to be coupled to one another. The bra includes a pair of bra wings, each bra wing in the pair having a first end and a second end, each first end being coupled to an outer edge of each bra cup, respectively, and the second ends configured to be coupled to one another. At least one of the pair of bra cups and the pair of bra wings comprises a layer of fabric having intrinsically sticky fibers. The layer of fabric having intrinsically sticky fibers comprises an inner layer of the at least one of the pair of bra cups and the pair of bra wings and contacts a wearer's skin while the bra is being worn, so as to cause the bra to cling to the wearer's skin.

According to another example of the present disclosure, a method of manufacturing a bra comprises providing a first fabric having intrinsically sticky fibers and providing a second fabric, having intrinsically sticky fibers. The first fabric having intrinsically sticky fibers is fashioned into a pair of bra cups, each bra cup in the pair has an inner edge and an outer edge, and the inner edges are configured to be coupled to one another. The second fabric having intrinsically sticky fibers is fashioned into a pair of bra wings, each bra wing in the pair has a first end and a second end, each first end is coupled to a respective one of the outer edges of the bra cups, and the second ends are configured to be coupled to one another. The method includes situating the pair of bra cups and the pair of bra wings such that the first fabric having intrinsically sticky fibers and the second fabric having intrinsically sticky fibers both contact a wearer's skin while the bra is being worn, so as to cause the bra to cling to the wearer's skin.

BRIEF DESCRIPTION OF THE DRAWINGS

Examples of articles of manufacture and methods for manufacturing garments and materials that can be used to construct garments are described with reference to the following figures. These same numbers are used throughout the figures to reference like features and like components.

DETAILED DESCRIPTION

The garment of the present disclosure is knitted using specific fibers, such as but not limited to polyester spandex, monopolyester, spandex, thermoplastic elastomers such as thermoplastic polyurethane (TPU) polymers, nylon, and latex. Specifically, in some examples, TPU polymers, spandex, and latex are used for their gripping abilities in order to cause the garment to cling, to the wearer's skin. These three fibers will hereinafter be referred to as "sticky fibers". These sticky fibers are used not only for their performance properties such as stretch characteristics and modulus levels, but for their intrinsic surface nature as well, because when they are knitted in certain combinations and according to certain patterns, the resulting fabric exhibits properties that causes it to cling to a wearer's body, providing a "tight-to-skin" feel. Fabric knitted according to the herein described patterns using the herein described fibers can be incorporated into not only a strapless bra as described below, but into any other category of garments, such as but not limited to sports bras, panties, shapewear, and active wear. Fabrics such as those described herein provide improvement in comfort and wearability. The fabrics have a clinging (or gripping) effect on the skin of the wearer.

In the knitted fabrics described herein, each intrinsically sticky fiber that is in contact with the skin absorbs a portion of the force applied by a wearer's body to a garment as it is worn. The different tensions around the body while the garment is worn will be spread over all the surfaces where the wearer's skin and the garment are in contact, thereby eliminating any localized pressure points. When the fabric is used in a bra, this spreading of tension further eliminates localized pressure points where the top and bottom of the bra wing dig and cut into the wearer's skin, where the tip of the underwire digs in, and where an optional strap on the top of the shoulder carries the weight of the wearer's breast. Specifically, the compression properties of the TPU polymer yarn emphasizes these benefits as well.

Figure 1:
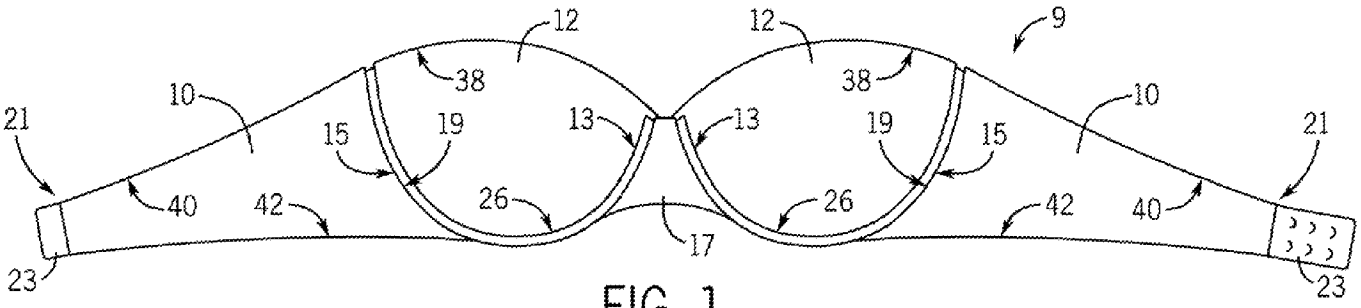
FIG. 1 depicts a front, or outer, view of one example of a bra according to the present disclosure.
Figure 2:
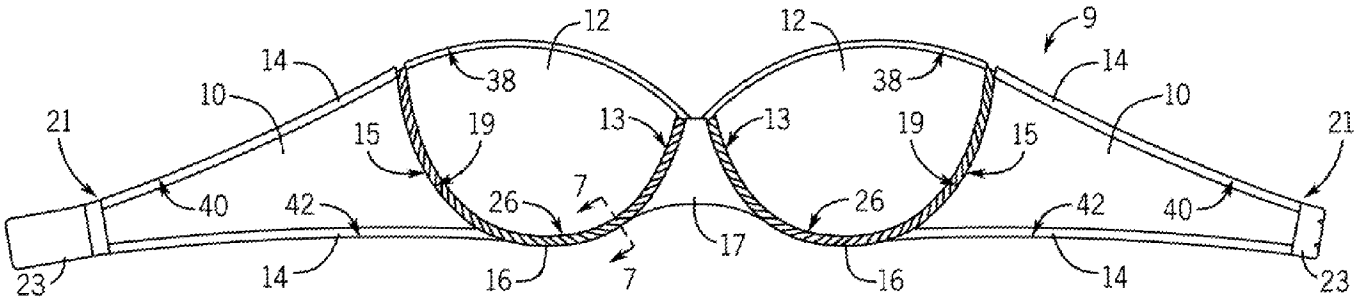
FIG. 2 depicts a back, or inner, view the bra of FIG. 1.

There are four specific areas of the exemplary bra described herein below, each of which has been modified so as to provide a strapless garment which can move with the wearer's body and stay in place for a longer period of time than prior art bras. With reference to FIGS. 1 and 2, these four specific areas include: (1) the bra wings 10; (2) the bra cups 12; (3) the elastic bands 14 in the underarm region; and (4) the underwire casings 16.

The bra 9 of the present disclosure comprises a pair of bra cups 12, each bra cup 12 in the pair having an inner edge 13 and an outer edge 15, the inner edges 13 configured to be coupled to one another. In the example shown, the inner edges 13 are coupled to one another by a center gore 17. However, the cups 12 of the bra 9 could he connected directly to one another or the bra 9 could instead comprise a bandeau bra having two cup areas for each of the wearer's breasts.

The bra further comprises a pair of bra wings 10, each bra wing 10 in the pair having a first end 19 and a second end 21. Each first end 19 is coupled to the outer edge 15 of each bra cup 12, respectively, and the second ends 21 are configured to be coupled to one another. In the example shown, the second ends 21 are configured to be coupled to one another by a hook and eye closure 23. In alternative embodiments, the wings 10 of the bra 9 are continuous and extend across the entirety of the wearer's back. In this instance, the center gore 17 may comprise a front closure or clasp for the bra 9.

At least one of the pair of bra cups 12 and the pair of bra wings 10 comprises a layer of fabric having intrinsically sticky fibers. The layer of fabric having intrinsically sticky fibers comprises an inner layer of the at least one of the pair of bra cups 12 and the pair of bra wings 10 and contacts a wearer's skin while the bra is being worn, so as to cause the bra 9 to cling, to the wearer's skin. As mentioned above, the intrinsically sticky fibers comprise one or more of thermoplastic polyurethane polymers, spandex, and latex, as will be further described herein below as well.

Bra Wing

The fabric of the bra wing 10 may be knitted in any fashion, so long as the sticky fiber is knitted on one side of the garment such that it can be placed in contact with the wearer's skin in the fashioned form of the garment. For example, the fabric can be a traditional single or double knit fabric, such as for example jersey knit, or a single knit plated jersey fabric. The fabric may be made with spandex, TPU polymer, or latex yarns. Alternatively, the fabric is lace or mesh.

Figure 3:
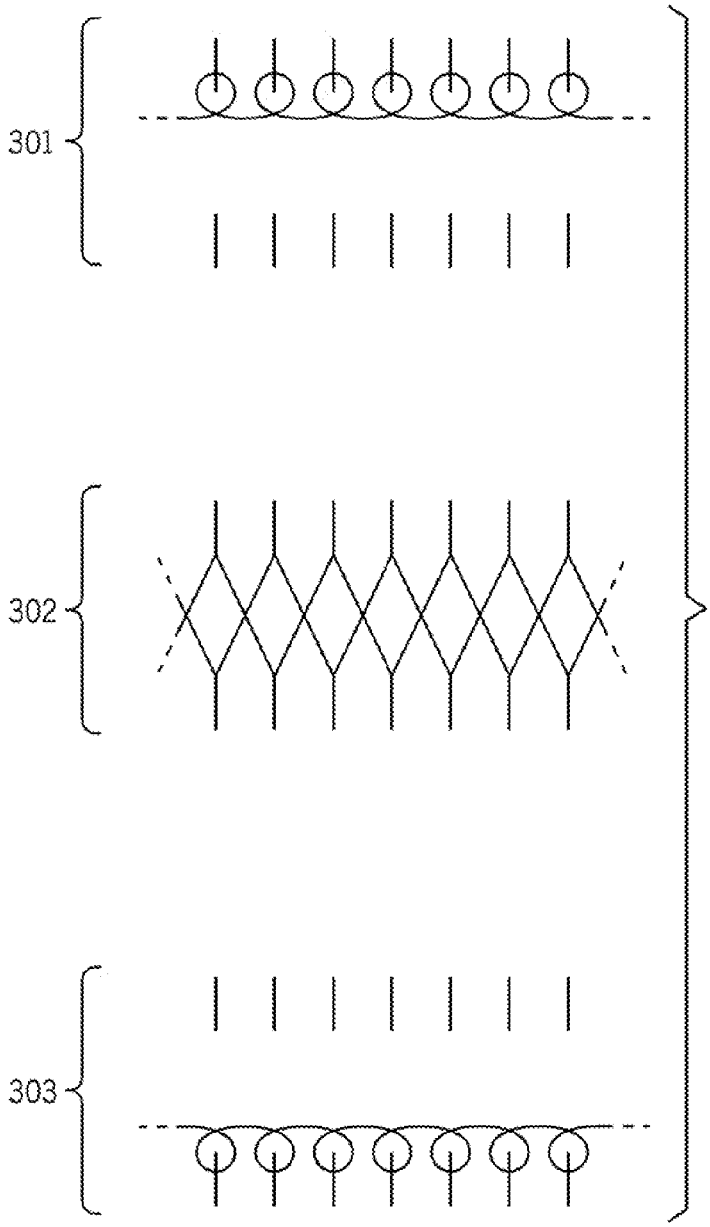
FIG. 3 depicts one example of a knitting pattern for knitting a fabric to be used for wings of the bra.

In one example as shown in FIG. 3, the bra wing 10 is a knitted three-layer fabric. in the example shown, the three-layer fabric comprises two layers of TPU polymer yarn and one layer of nylon yarn. The two layers of TPU polymer yarn are in middle and back (the inner face side that contacts the wearer's skin) and the nylon layer is on the outside of the wing (facing away from the wearer's skin). The knitting pattern used to create a three-layer fabric with nylon and TPU polymer yarn will now be described.

In the knitting pattern of FIG. 3, layer 301 is meant to face away from the wearer's skin and layer 303 is meant to contact the wearer's skin. Layer 301 is made of 40D/34F nylon yarn, which is set up on the first feed of a knitting machine. Both the second and third feeds of the knitting machine are set up with 70D TPU polymer yarn so as to knit the middle layer 302 of the fabric. The layer 303 that contacts the wearer's skin the back or inner layer) is also made of 70D TPU polymer yarn and is set up on the fourth feed of the knitting machine. All three layers 301, 302, 303 are then knitted together using the knitting machine to form the three-layer fabric.

In one example, the TPU polymer yarn may be an elastic fiber that has a relatively flat modulus curve at between 100% and 200% elongation. The elastic fiber is made from thermoplastic polyurethane polymers and is made by a melt-spinning process where the fiber is wound onto bobbins at a speed just slightly higher than the melt velocity of the polymer exiting the spinneret. The TPU polymer yarn is strong due to its high molecular weight for a given denier. The TPU polymer yarn therefore provides a good elastic, modulus, which is needed during wearing. The TPU polymer yarn is thin and breathable. The TPU polymer yarn has high stretch because of its thermoplastic nature. Also at higher (body) temperature, its elongation will be increased by about 10% to 20% over that at room temperature. Its stretchiness can react to the body's temperature to provide more comfort during wearing. In one example, the TPU polymer yarn is created according to the processes described in U.S. Patent Publication No. 2010/0325782 and/or U.S. Pat. Nos. 7,763,351 and 7,799,255, all assigned to Lubrizol Advanced Materials, Inc., of Cleveland, Ohio. Lubrizol sells an exemplary TPU polymer yarn under the trademark $X4_{ZOL}$™-J. Other TPU polymers or even other types of thermoplastic elastomers could be used for the fibers as well.

Fabric knitted from the TPU polymer yarn controls compression in 360° and in three dimensions (x-y-z), thereby providing comfort, shape, and support while allowing more freedom of movement. This three-dimensional nature allows fabric knitted from the TPU polymer yarn to balance stresses in order to allow freedom of movement. Fabric knitted from the TPU polymer yarn is easy to stretch in the x-y direction, so a garment made from the fabric is easy to put on and take off. Further, fabric made from the TPU polymer yarn provides compression in the z direction. This can help to hold the garment to the body more tightly.

When the TPU polymer yarn is exposed to the wearer's skin, its gripping surface helps the garment to stay up. A fabric, knitted with TPU polymer yarn generally has higher gripping effect than other fabrics without TPU polymer yarn. For example, the three-layer fabric knitted with TPU polymer yarn as disclosed herein (FIG. 3) has higher gripping ability than normal nylon fabric. Fabric knitted with the TPU polymer yarn has more stretch and gripping ability than normal nylon and/or spandex as well. The TPU polymer yarn is thinner, but stronger (still with good breathability) than normal elastic fiber.

In another example, the knitted three-layer fabric of the bra wing it) comprises a spandex layer in the back (layer 303) and middle (layer 302), and a nylon layer in the front (layer 301). This fabric is knitted according to the pattern shown in FIG. 3, only spandex replaces the TPU polymer yarn on the second, third and fourth feeds of the knitting machine.

In another example, the knitted three-layer fabric of the bra wing may 10 also comprise various combinations of yarn made from nylon, TPU polymers, and spandex, in any of the front, middle, or back layers.

In another example, the bra wing 10 comprises one or more layers of single knit or double knit fabric, such as for example jersey knit fabric, and is knit from nylon, polyester, nylon-polyester blend, or other yarn, laminated to a 100% spandex layer of fabric. The bra wing 10 could alternatively be lace or mesh knit from any of the above-mentioned types of yarns laminated to 100% spandex or with spandex as the back yarn. The 100% spandex layer of fabric rests against the wearer's skin to provide a gripping effect. In another example, a single knit or double knit fabric is knitted with spandex at the back. In yet other examples, the bra wing 10 is knitted as a spacer fabric, such as, for example, shown in FIGS. 4 and 5.

Bra Cup

The fabric of the bra cup 12 may be knitted in any fashion, so long as the sticky fiber is knitted on one side of the garment such that it can be placed in contact with the wearer's skin in the fashioned form of the garment. For example, the fabric can be a traditional single or double knit fabric, such as a single knit plated jersey fabric, mesh, or lace. The fabric can be made with spandex, TPU polymers, or latex yarns.

Figure 4:
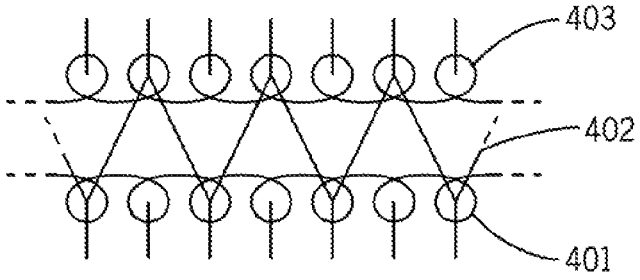
FIG. 4 depicts one example of a knitting pattern for knitting, a fabric to be used for cups of the bra.

In one example as shown in FIG. 4, the bra cup 12 is made of a knitted spacer fabric. The spacer fabric is a three-dimensional fabric that has an inner face layer 401, an outer face layer 403, and a pile/connecting layer 402. The knitted spacer fabric comprises three types of yarns: 55D 100% spandex yarn 401 on the back (the inner face side that contacts the wearer's skin), 50D/1F monopolyester yarn 402 in the middle, and polyester spandex yarn 403 (spandex is 55D and polyester is 75D/72F) on the front (facing away from the wearer's skin). (See also description of FIG. 6, herein below.) The 100% spandex is provided as part of the spacer fabric by knitting and is exposed on the back/inner face of the spacer fabric such that it contacts a wearer's skin and clings thereto. The spacer fabric has a higher modulus than a single knit fabric or a double knit fabric (rib or interlock). The spacer fabric, of the bra cup 12 is light and breathable. The spacer fabric is also lightweight, so it is less susceptible to gravity tending to pull it down along the wearer's torso. However, the spacer fabric is still thick enough to give some level of modesty and support.

The 100% spandex back/inner face layer (yarn 401) clings/grips onto the skin, and replaces the typical silicone elastic used to hold a strapless bra up, which has a high modulus and often causes discomfort and irritation to the wearer at the above-mentioned pressure points.

In another example, yarn 401 is polyester spandex, yarn 402 is monopolyester, and yarn 403 is polyester spandex.

Figure 5:
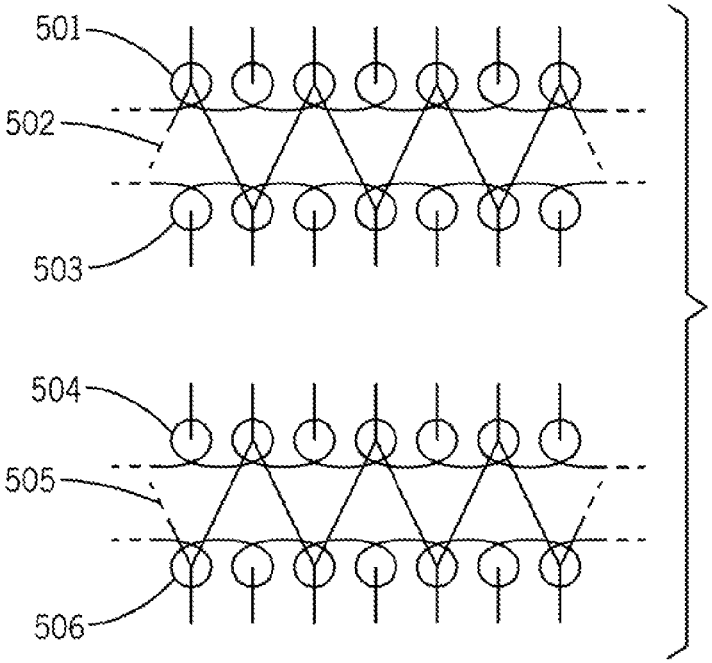
FIG. 5 depicts another example of a knitting pattern for knitting a fabric to be used for cups of the bra.

In another example, as shown in FIG. 5, the spacer fabric of the bra cup 12 is a "striped" version, comprising hard yarn (e.g., polyester) and stretch yarn (e.g., spandex) on the back/inner face of the bra cup 12 in stripes. For example, the striped pattern of the fabric may comprise X courses of knitting where 100% spandex yarn is provided on the back of the bra cup 12, followed by Y courses of polyester yarn knitted with spandex yarn on the back side of the bra cup 12, repeated. For example, in the first course of knitting, yarn 501 can be polyester spandex, yarn 502 can be monopolyester, and yarn 503 (on the inner face of the fabric) can be spandex. In the second course, yarn 504 can be polyester spandex, yarn 505 can be monopolyester, and yarn 506 (on the inner face of the fabric) can be polyester spandex. The values of X and Y for the numbers of courses of knitting in each stripe can be chosen to provide different width to the "stripes". In another example, nylon yarn is used instead of polyester yarn, and the nylon yarn and 100% spandex yarn form the striped pattern.

Figure 6:
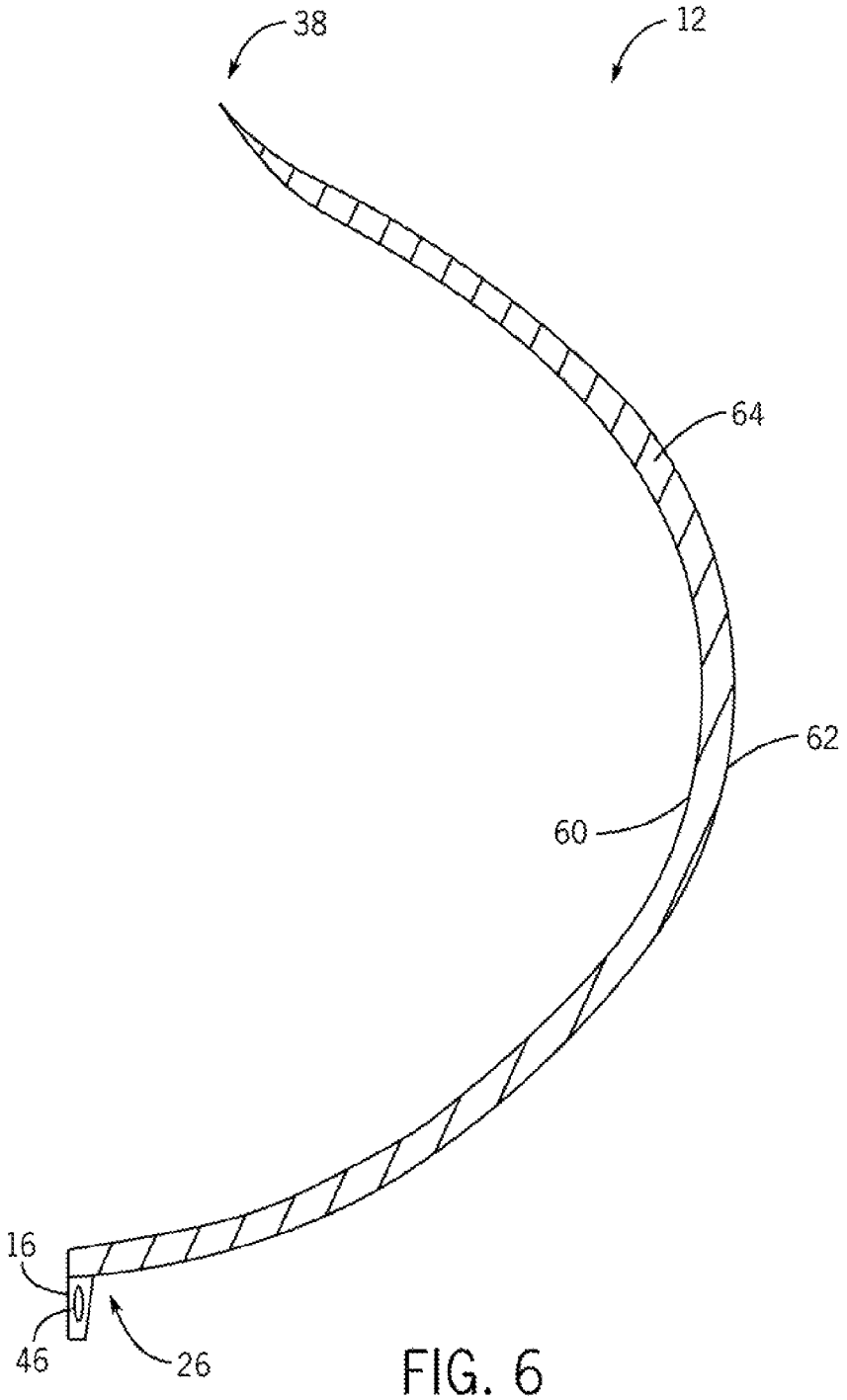
FIG. 6 depicts one example of a cross-sectional view of a cup of the bra.

As another alternative, a single knit or double knit fabric is knitted with spandex at the back, such that the spandex contacts the wearer's skin. As another alternative, a single knit, double knit, or spacer fabric knitted from nylon and/or polyester may be laminated to a 100% spandex fabric. If this 100% spandex fabric is provided on the back of the bra cup 12, it has a similar gripping effect to the spacer fabric with spandex knitted into the inner face layer, described herein above with reference to FIG. 4. In another example, as shown in FIG. 6, a foam cup 64 is laminated with 100% spandex fabric that forms an inner face 60 of the bra cup 12, such that the 100% spandex fabric layer contacts the wearer's skin and provides a clinging/gripping effect. An outer face 62 of the bra cup 12 is made of fabric sewn or laminated to an opposite side of the foam cup 64, and may be formed of any fabric suitable to bra construction. Additionally, in the example in which the bra cup 12 comprises a spacer fabric with a sticky fiber, for example 100% spandex yarn, provided on the back of the bra cup 12 such that it contacts a wearer's skin, the inner face 60 could be the sticky (e.g. 100% spandex) back face of the spacer fabric, the area indicated at 64 could be the pile/connecting layer made of monopolyester (or other yarn), and the outer face 62 could be polyester spandex (or other type of yarn).

As another alternative, a spacer fabric knitted from nylon and/or polyester may be knitted with TPU polymer yarn as the back layer.

As another alternative, a spacer fabric knitted from nylon and/or polyester may be knitted with multifilament yarn as the middle layer, rather than monofilament yarn.

Underwire Casing

Figure 7:
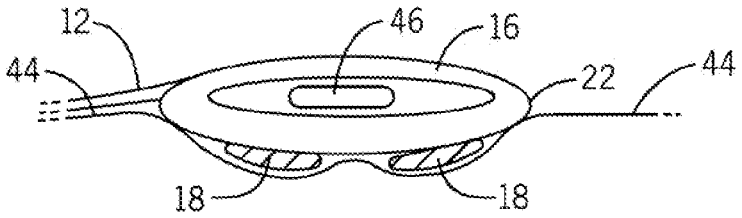
FIG. 7 depicts a cross-sectional view of one example of an underwire casing to be used for the bra of the present disclosure.

Referring to FIGS. 2 and 7, the bra 9 may be provided with a pair of underwire casings 16, each holding an underwire 46. Each underwire casing 16 is coupled to a lower edge 26 of each bra cup 12. The pair of underwire casings 16 may be provided with silicone stripes 18 for contacting the wearer's skin. The silicone stripes 18 enhance the clinging/gripping effect of the bra 9 while helping to anchor the bra 9 in position as it moves with the body.

The silicone stripes 18 create resistance in opposition to the force of gravity, which tends to pull the cup down along the wearer's torso. This can help to better anchor the bra cup 12 to the body. Silicone stripes 18 provide a surface for contact with the skin 44 (see FIG. 7), thereby providing this upward vertical resistance to gravity, yet maintain breathability of the underwire casing 16 because not the entire surface of the underwire casing 16 is printed with silicone. In other words, the striped nature of the silicone stripes 18 allows for air flow.

Silicone stripes 18 can be printed or painted on to the underwire casing 16 in many different ways, one of which is provided by Stretchline USA Inc. of Rocky Mount, N.C. Some types of silicone that may be used, and processes associated therewith, are provided in U.S. Patent Publication Nos. 2006/0154053 and 2009/0053441, as well as GB 2305870 A.

Figure 8:
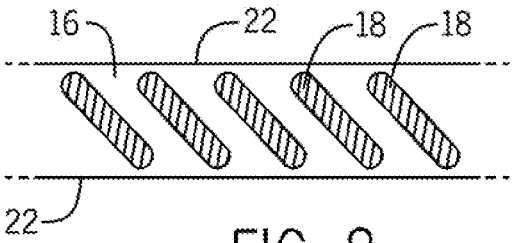
FIG. 8 depicts a close-up back, or inner, view of the underwire casing shown in FIG. 7.
Figure 9:
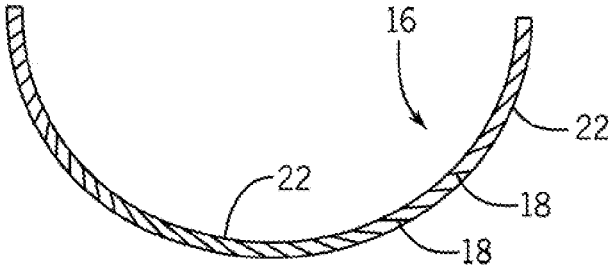
FIGS. 9-11 depict several alternative examples of back, or inner, views of underwire casings.

In one example, as shown in FIGS. 8 and 9, the silicone stripes 18 are angled with respect to the wearer's torso and with respect to the edge 22 of the underwire casing 16). This allows for accurate positioning of the silicone stripes 18 on the wearer's torso no matter what size the bra is. Angled stripes are also easy to produce/apply on an underwire casing 16.

Figure 10:
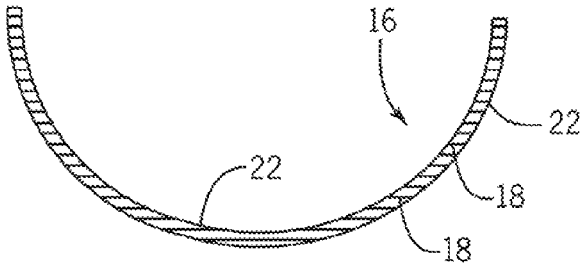

In one example, the silicone stripes 18 are horizontal with respect to the wearer's torso. (FIG. 10).

Figure 11:
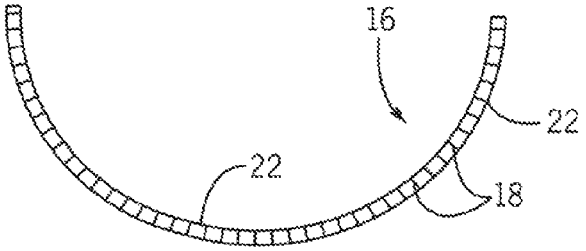

In another example, the silicone stripes are perpendicular to the edge 22 of the underwire casing 16. (FIG. 11).

Figure 12:
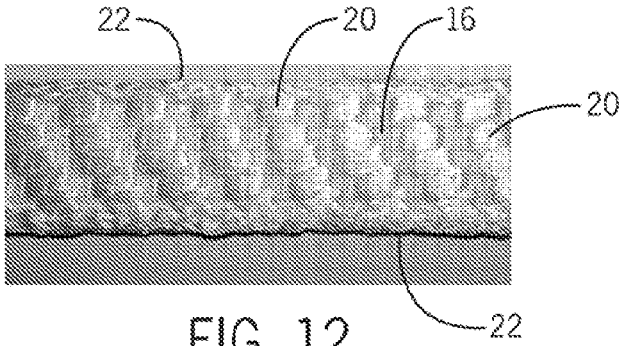
FIG. 12 depicts an alternative example of an underwire casing to be used in the bra of the present disclosure.

In another example, a rib 20 can be woven into the underwire casing 16, instead of or in addition to providing silicone stripes. See FIG. 12. The rib 20 can be angled with respect to the edge 22 of the underwire casing 16 (FIG. 12) or can be perpendicular to the edge 22 (similar to FIG. 11).

Elastic Bands

Figure 13:
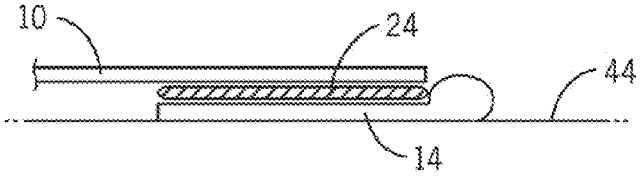
FIG. 13 depicts a cross-sectional view of an elastic band area of the bra.

With reference to FIG. 13, the bra further comprises elastic bands 14 coupled to an upper edge 40 and a lower edge 42 (FIG. 2) of each bra wing 10 on the inside of the bra wings 10 so that the elastic bands 14 contact the wearer's skin 44. The elastic bands 14 may be knitted of TPU polymer yarn, so that the wing 10 has even stretch and recovery. When the raw edge of the bra wing 10 is glued to the elastic bands 14, this provides a smooth look on the back of the wearer, i.e., no seam lines or lumps are present.

The top and bottom elastic bands 14 provided on the bra wing 10 may be glue bonded with glue 24 to the bra wing 10 using a low temperature one-step bonding process. This provides stretch and a body-matching effect, as the elastic bands 14 move with the wearer.

Glue bonding gives high stretch, and requires only low temperature bonding. Because TPU polymer yarn is heat-sensitive, there is a possibility of shrinkage if the TPU polymer yarn is heated to high temperatures while the bra wing 10 is bonded to the elastic bands 14. As both the elastic bands 14 and the bra wing 10 may comprise TPU polymer yarn, if temperatures can be kept low, this runs less risk of heat-shrinking the TPU polymer yarn. A glue bonding machine is set to around 120-130 degrees Celsius, which is a low temperature that will not cause shrinkage attic TPU polymer yarn.

Glue bonding allows application of glue in different thicknesses on different parts of the garment as it is applied. Thickness can also be varied at finer levels (microns). Glue bonding such as that described herein can be done with glue provided by MAS Holdings of Colombo, Sri Lanka or MAS Intimates of Kandawala Estate, Ratmalana, Sri Lanka. In one example, the glue includes NCO-terminated urethane prepolymers and 4,4-methylenediphenyl diisocyanate.

Alternatively, the elastic bands 14 may be held to the bra wing 10 by heat-attached ("hot-melt") adhesive tape, such as, for example, that provided by BemisTape of Minneapolis, Minn. Alternatively, the elastic bands 14 may be ultrasonically bonded to the bra wings 10. Alternatively, the elastic bands 14 may be sewn to the bra wings 10.

Alternatively, the elastic bands 14 may be made of spandex or latex instead of TPU polymers.

Add-One-Size

Figure 14:
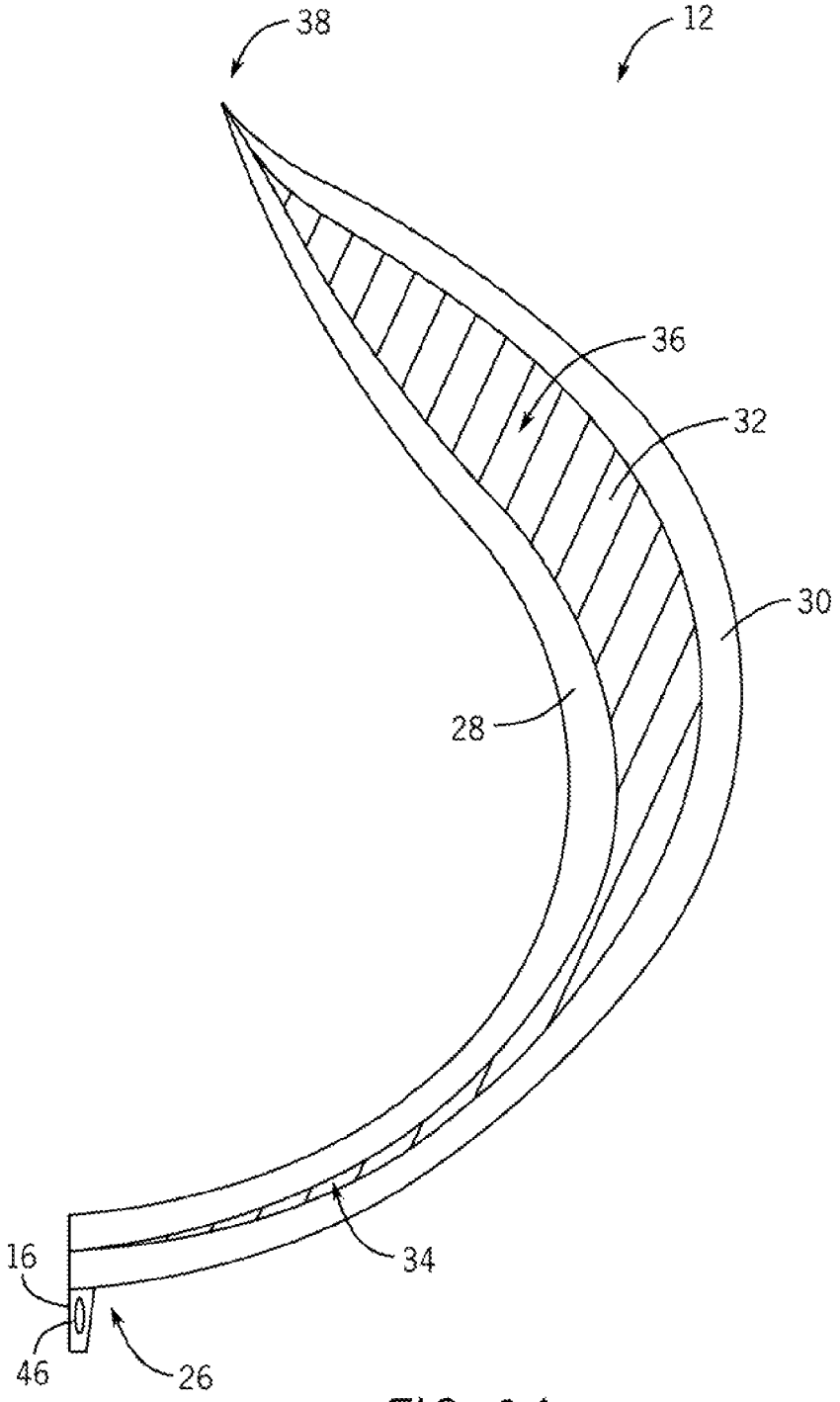
FIG. 14 depicts another example of a cross-sectional view of a cup of the bra.
Figure 15:
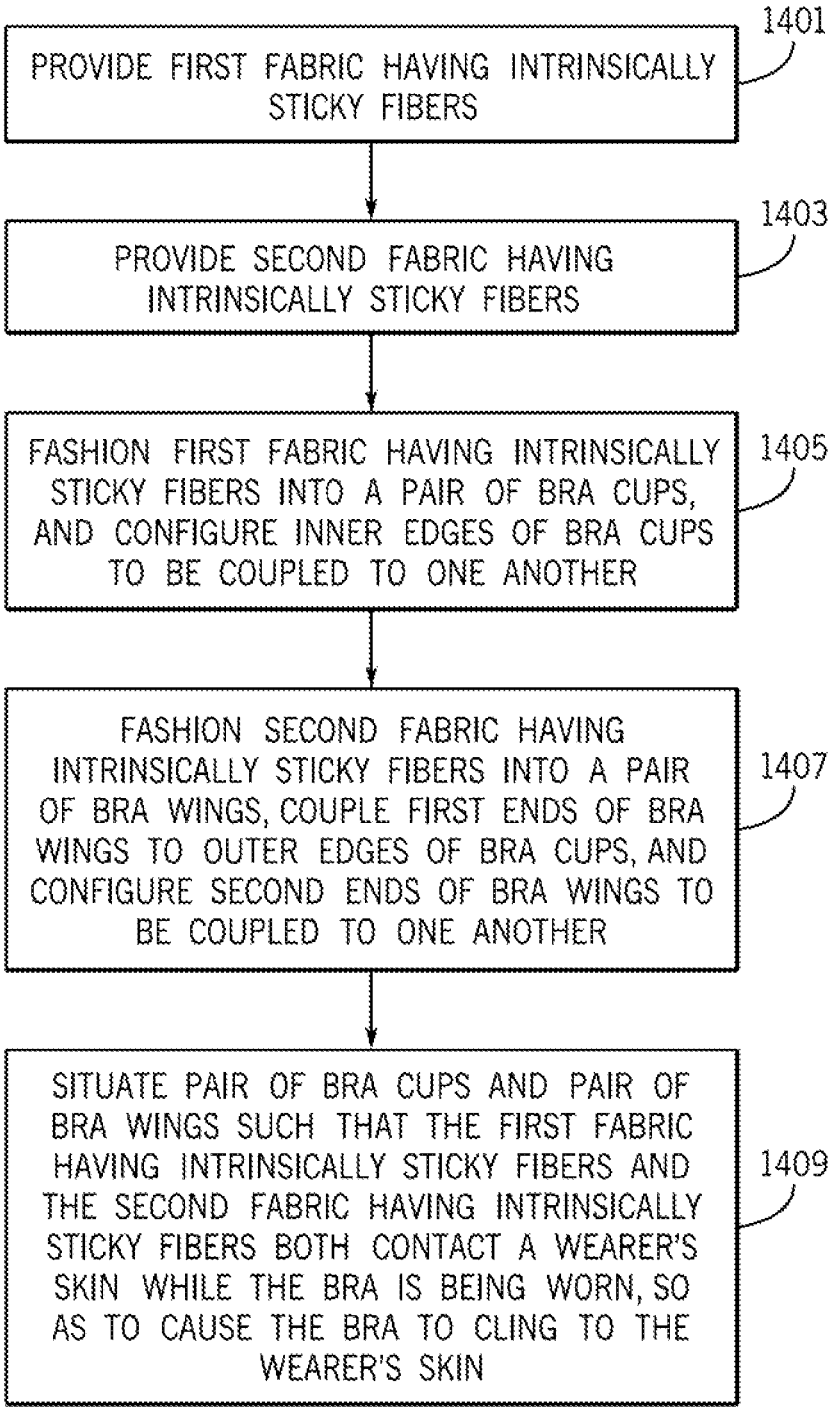
FIG. 15 shows a method of manufacturing a bra according to the present disclosure.

As shown in FIG. 14, each bra cup 12 may comprise an inner bra cup 28 of a first size and an outer bra cup 30 of a second size that is larger than the first size. A layer of foam 32 may be situated between the inner and outer bra cups 28, 30. The inner and outer bra cups 28, 30 may be sewn or laminated to the layer of foam 32, and may comprise any fabric suitable for bra construction. The layer of foam 32 forms a thin ledge 34 proximate the lower edge 26 of the bra cup 12. The layer of foam 32 gradually widens to a thickest portion 36 above an apex of a wearer's breast and gradually thins toward an upper edge 38 of the bra cup 12. Together, the inner bra cup 28, outer bra cup 30, and layer of foam 32 provide the appearance of an increased cup size to a wearer's breast. The inner bra cup 28 conforms to the actual shape and size of the wearer's breast. The layer of foam 32 adds volume mostly above the apex of the wearer's breast (i.e., the nipple), and the outer bra cup 30 provides a smooth finish to the layer of foam 32. The thin ledge 34 made of foam lifts the wearer's breasts and counters the effect of gravity on the wearer's breasts, aiding the intrinsically sticky materials that make up the rest of the bra so as to hold the bra up even when no straps are provided. Additionally, because the high points of the inner bra cup 28 and outer bra cup 30 are not aligned, this allows the wearer's breast to sit in its natural shape within the inner bra cup 28.

Method

The present disclosure also contemplates a method of constructing the bra 9 shown in FIGS. 1 and 2, including knitting the above-described fabrics, molding the fabrics into bra cups 12, cutting and/or molding the fabrics into bra wings 10, attachment of the bra cups 12 and bra wings 10, and attachment of the elastic bands 14 and underwire casing 16 to the bra 9 as described herein above.

In one example, the method comprises providing a first fabric, having intrinsically sticky fibers, as shown at 1401. The method also comprises providing a second fabric having intrinsically sticky fibers, as shown at 1403. The method next comprises fashioning the first fabric having intrinsically sticky fibers into a pair bra cups 12, each bra cup 12 in the pair having an inner edge 13 and an outer edge 15, and configuring the inner edges 13 to be coupled to one another, as shown at 1405, in one example, the inner edges 13 are coupled to one another by a center gore 17. The method may further comprise fashioning the second fabric having intrinsically sticky fibers into a pair of bra wings 10, each bra wing 10 in the pair having a first end 19 and a second end 21, coupling each first end 19 to a respective one of the outer edges 15 of the bra cups 12, and configuring the second ends 21 to be coupled to one another, as shown at 1407. In one example, the second ends 21 are coupled to one another with a hook and eye closure 23. The method further comprises situating the pair of bra cups 12 and the pair of bra wings 10 such that the first fabric having intrinsically sticky fibers and the second fabric, having intrinsically sticky fibers both contact a wearer's skin while the bra is being, worn so as to cause the bra to cling to the wearer's skin, as shown at 1409.

The intrinsically sticky fibers may comprise one or more of thermoplastic polyurethane polymers, spandex, and latex. The first fabric may comprise a knitted spacer fabric. The knitted spacer fabric may comprise an inner face knitted of spandex that contacts the wearer's skin. The second fabric may comprise a three layer fabric, and the three layer fabric may comprise an inner face knitted of thermoplastic polyurethane polymer that contacts the wearer's skin.

The method may further comprise providing a pair of underwire casings 16 having silicone stripes 18 for contacting the wearer's skin, and coupling each underwire casing 16 to a lower edge 26 of each of the bra cups 12, respectively. The method may further comprise fashioning an inner bra cup 28 of a first size and an outer bra cup 30 of a second size that is larger than the first size and situating a layer of foam 32 between the inner and outer bra cups 28, 30. The layer of foam 32 forms a thin ledge 34 proximate the lower edge 26 of the bra cup 12, gradually widens to a thickest portion 36 above an apex of a wearer's breast, and gradually thins toward an upper edge 38 of the bra cup 12. The method may further comprising coupling elastic bands 14 to an upper edge 40 and a lower edge 42 of each bra wing 10 in the pair of bra wings 10. The method may further comprise gluing the elastic bands 14 to each bra wing 10.

In the above description certain terms have been used for brevity, clarity, and understanding. No unnecessary limitations are to be inferred therefrom beyond the requirement of the prior art because such terms are used for descriptive purposes and are intended to be broadly construed. The different articles of manufacture and methods described herein above may he used in alone or in combination with other articles of manufacture and methods.

What is claimed is:

1. A bra comprising:

a pair of bra cups, each bra cup in the pair having an inner edge and an outer edge, the inner edges configured to be coupled to one another; and a pair of bra wings, each bra wing in the pair having a first end and a second end, each first end being coupled to the outer edge of each bra cup, respectively, and the second ends configured to be coupled to one another;

wherein at least one of the pair of bra cups and the pair of bra wings comprises a layer of fabric having intrinsically sticky fibers; and wherein the layer of fabric having intrinsically sticky fibers comprises an inner layer of the at least one of the pair of bra cups and the pair of bra wings and contacts a wearer's skin while the bra is being worn, so as to cause the bra to cling to the wearer's skin.

2. The bra of claim 1, wherein the intrinsically sticky fibers comprise one or more of thermoplastic polyurethane polymers, spandex, and latex.

3. The bra of claim 2, wherein the pair of bra cups comprises a knitted spacer fabric.

4. The bra of claim 3, wherein the knitted spacer fabric comprises an inner face knitted of spandex for contacting the wearer's skin.

5. The bra of claim 2, wherein the pair of bra wings comprises a three-layer fabric.

6. The bra of claim 5, wherein the three-layer fabric comprises an inner face knitted of thermoplastic polyurethane polymer for contacting the wearer's skin.

7. The bra of claim 1, further comprising a pair of underwire casings, each underwire casing coupled to a lower edge of each bra cup, respectively, wherein the pair of underwire casings is provided with silicone stripes for contacting the wearer's skin.

8. The bra of claim 7, wherein each bra cup in the pair of bra cups comprises:

an inner bra cup of a first size and an outer bra cup of a second size that is larger than the first size; and a layer of foam situated between the inner and outer bra cups;

wherein the layer of foam forms a thin ledge proximate the lower edge of the bra cup, gradually widens to a thickest portion configured to be located above an apex of a wearer's breast, and gradually thins toward an upper edge of the bra cup.

9. The bra of claim 1, further comprising elastic bands coupled to an upper edge and a lower edge of each bra wing in the pair of bra wings.

10. The bra of claim 9, wherein the elastic bands comprise a thermoplastic polyurethane polymer and are glued to each bra wing.

11. A method of manufacturing a bra, the method comprising:

providing a first fabric having intrinsically sticky fibers;

providing a second fabric having intrinsically sticky fibers;

fashioning the first fabric having intrinsically sticky fibers into a pair of bra cups, each bra cup in the pair having an inner edge and an outer edge, and configuring the inner edges to be coupled to one another;

fashioning the second fabric having intrinsically sticky fibers into a pair of bra wings, each bra wing in the pair having a first end and a second end, coupling each first end to a respective one of the outer edges of the bra cups, and configuring the second ends to be coupled to one another; and situating the pair of bra cups and the pair of bra wings such that the first fabric having intrinsically sticky fibers and the second fabric having intrinsically sticky fibers are both configured to contact a wearer's skin while the bra is being worn, so as to cause the bra to cling to the wearer's skin.

12. The method of claim 11, wherein the intrinsically sticky fibers comprise one or more of thermoplastic polyurethane polymers, spandex, and latex.

13. The method of claim 12, wherein the first fabric comprises a knitted spacer fabric.

14. The method of claim 13, wherein the knitted spacer fabric comprises an inner face knitted of spandex that is configured to contact the wearer's skin.

15. The method of claim 12, wherein the second fabric comprises a three-layer fabric.

16. The method of claim 15, wherein the three-layer fabric comprises an inner face knitted of thermoplastic polyurethane polymer that is configured to contact the wearer's skin.

17. The method of claim 11, further comprising providing a pair of underwire casings having silicone stripes for contacting the wearer's skin, and coupling each underwire casing to a lower edge of each of the bra cups, respectively.

18. The method of claim 17, further comprising:

fashioning an inner bra cup of a first size and an outer bra cup of a second size that is larger than the first size; and situating a layer of foam between the inner and outer bra cups;

wherein the layer of foam forms a thin ledge proximate the lower edge of the bra cup, gradually widens to a thickest portion configured to be located above an apex of a wearer's breast, and gradually thins toward an upper edge of the bra cup.

19. The method of claim 11, further comprising coupling elastic bands to an upper edge and a lower edge of each bra wing in the pair of bra wings.

20. The method of claim 19, further comprising gluing the elastic bands to each bra wing.

* * * * *